United States Patent [19]

DeLuca

[11] 4,340,195

[45] Jul. 20, 1982

[54] DISPENSER FOR ROLLED FLEXIBLE SHEET MATERIAL

[75] Inventor: Raymond F. DeLuca, Stamford, Conn.

[73] Assignee: Georgia-Pacific Corporation, Portland, Oreg.

[21] Appl. No.: 197,524

[22] Filed: Oct. 16, 1980

Related U.S. Application Data

[63] Continuation-in-part of Ser. No. 58,867, Jul. 19, 1979, Pat. No. 4,307,639, which is a continuation of Ser. No. 897,431, Apr. 18, 1978, abandoned.

[51] Int. Cl.[3] ..... B65H 19/04; B65H 17/42

[52] U.S. Cl. ..... 242/55.3; 226/110; 242/55.53; 312/39

[58] Field of Search ..... 242/55.53, 55.3, 55.2, 242/55.42; 312/39, 40, 41, 38; 226/110

[56] References Cited

U.S. PATENT DOCUMENTS

| | | | |
|---|---|---|---|
| 3,672,552 | 6/1972 | Krueger | 242/55.53 |
| 3,700,181 | 10/1972 | Diring | 242/55.3 |
| 3,770,222 | 11/1973 | Jespersen | 242/55.3 |
| 3,771,739 | 11/1973 | Nelson | 242/55.3 |
| 3,865,295 | 2/1975 | Okamura | 242/55.3 |

*Primary Examiner*—Edward J. McCarthy

*Attorney, Agent, or Firm*—Schuyler, Banner, Birch, McKie & Beckett

[57] ABSTRACT

A dispenser to accommodate source and reserve rolls of flexible sheet material has a housing provided with inwardly facing tracks on the opposite inner side walls thereof and guide means associated with each track adjacent the lower end thereof to drivingly assist the source roll dispensing action with a reserve roll segregating device cooperating between the guide means and the reserve roll to both hold the reserve roll away from the dispensing position of the source roll and urge the guide means to brake against over-spin of the source roll incident withdrawal of sheet material therefrom.

6 Claims, 6 Drawing Figures

26
22
28
56
54
50
44
52
40
42
46
32
60
36
58
62
34

DISPENSER FOR ROLLED FLEXIBLE SHEET MATERIAL

BACKGROUND OF THE INVENTION

This is a Continuation-In-Part of DeLuca patent application Ser. No. 58,867 filed July 19, 1979 now U.S. Pat. No. 4,307,639 issued Dec. 29, 1981, which is a Continuation of abandoned DeLuca patent application Ser. No. 897,431 filed Apr. 18, 1978, abandoned.

This invention relates to dispensers for wound rolls of flexible sheet material that have supporting spindles projecting outwardly from the roll core ends. Such dispensers are particularly suitable for rolls of paper towels, tissue paper and the like. More specifically, these dispensers are constructed to accommodate multiple rolls with one roll being disposed in a dispensing position, acting as a source roll, and one or more additional rolls serving as reserve rolls in readiness to move into the dispensing position and thereupon form the source roll.

The now common use of paper towel dispensers in wall mounted locations where towel availability is desired has led to a variety of dispenser constructions where the web is drawn from wound rolls of flexible sheet material. Large numbers of such dispensers are commercially used in factories, office buildings, institutions, etc. Considering the substantial expense in time and labor required incident replenishing the exhausted wound rolls in such dispensers, simplicity and reliability in the construction and design of the dispenser to accommodate a plurality of wound rolls has become essential.

Accordingly, many structures have been developed to accommodate multiple rolls of wound sheet material so that the individual dispenser need only be replenished when the entire complement of rolls within the dispenser has been exhausted, namely, where a source roll has been used up and a reserve roll is available within the dispenser to move into the dispensing position and thereupon become and be used up as the source roll. Obviously, this reduces the time and expense required in replenishing rolls in the multitude of dispensers that are commonly employed in commercial establishments.

One of several problems that has been encountered in effectively handling dispensers for rolled flexible sheet material has been the tendency for the source roll to overspin or "spool" when the intending towel user suddenly and rapidly draws the towel web out of the dispenser housing. This undesired uncoiling of the spirally wound web at the end of each dispensing cycle may cause the particular dispenser to jam in one of several ways with, in any event, this particular dispenser becoming unavailable for dispensing further web material until attention is given to the dispenser by an attendent opening the dispenser housing and clearing the jammed condition. The loose uncoiled webbed material can create a jammed condition, for example, by digressing laterally into mechanism at a side wall of the dispenser housing, by folding into the feed rollers or web cutter mechanism of the dispenser, etc.

The prior art has addressed this particular problem of controlling the moment of inertia of the rotating components including the wound rolls of web material by different techniques, such as, using a simple spring brake that presses against the end of the roll to retard the undesired overspinning or uncoiling of the web that may occur at the end of each dispensing cycle. Frequently these braking techniques undesirably add to the resistance encountered by the towel user as he attempts to withdraw the toweling web from the dispenser. Excessive braking will of course contribute to the possibility of the web prematurely separating or parting within the dispenser with the consequent result of the next dispenser user finding the leading end of the web to be absent and thus unavailable for him to grasp and withdraw web material from the dispenser.

This problem of overspooling or uncoiling of the wound web on a roll as the web is withdrawn from a dispenser is also characterized by different parameters to be dealt with when the particular source roll in the dispensing position within the dispenser is a full roll or a roll where its size has been materially diminished to the point of being nearly depleated. A full source roll has the greatest moment of inertia due to its greatest roll mass whereas when the source roll is reduced in size its moment of inertia is proportionately diminished. These differing characteristics, depending upon the size of the source roll at the particular point in time that the dispenser is being called into use, are also considerations which must be kept in mind for the dispenser construction to find acceptability in the multitude of wall mounted locations where it may be positioned; locations where the dispenser may have limited attention by servicing personnel. Basically, the problem calls for structure that is simple yet effective if the dispenser is to be readily understood and adaptable to easy loading by attendants and be free from the potential for jamming in the absence of service attendant availability. Obviously, with multiple roll dispensers, it should be possible for the time between service attendant calls to be of longer duration if the multiple roll type dispenser construction is to be acceptable.

It is with the above concepts and problems relating to dispensers for wound rolls of flexible sheet material in mind that the instant invention has been made.

SUMMARY OF THE INVENTION

The present invention contemplates a wound roll dispenser fully capable of handling a multiple of rolls wherein each roll is located in the dispenser housing on supporting spindles projecting outwardly from the roll core ends. Inwardly facing tracks on the opposite inner side walls of the dispenser housing receive the outwardly projecting spindles that are fixedly held in the roll core ends, either in the form of core end caps or a mandrel providing spindles extending from the opposite core ends. The end cap or mandrel is desirably specifically constructed to promote rotation of the rolls as they move downwardly within the sidewall tracks. The lowermost roll engages with and is driven by a rotatably mounted feed roller disposed adjacent the lower ends of the tracks.

The inwardly facing tracks on the opposite inner side walls of the dispensing housing, within which the spindles extending from the roll core ends are supported, each have a lower end section slanting away from the longitudinal axis of the main length of the track and generally slanting toward a position tangent to the perimeter of the feed roller.

This lower end section of each track is provided with a pivotally supported guide that is biased inwardly toward the center line of the track with which it is associated, this guide being disposed on the lower side of the slanting track section. The biased guides promote rotation of the wound roll passing down the tracks by their action in pressing against the periphery of the spindles at the opposite ends of the roll core. Thus, roll rotation and consequent web dispensing from the roll is promoted during downward movement within the tracks.

Actually, the lower end section of each track need not necessarily be slanted but each track should have the inwardly biased guide disposed on the side of the track that is located in the direction that the sheet material will be drawn off of a roll when it is engaging the feed roller and while being drawn out of the dispenser.

To achieve the desired control for the wound source roll against over spinning or uncoiling at the end of each dispensing cycle, each of the above mentioned tracks has a reserve roll segregating device associated therewith. This device, one located at each of the opposite inner side walls of the housing, has an upper portion to engage a reserve roll spindle which is cooperatively engaged within the track. This upper portion serves to retain the reserve roll adjacent the upper ends of these tracks. Each device also has a lower portion pressing against the biased guide with which it is associated to augment the biasing action in urging the friction surfaces of the guides against the periphery of the source roll spindles disposed within the lower ends of the tracks.

Preferably the upper portion of each reserve roll segregating device has a stepped configuration extending in a generally vertical direction to permit the reserve roll to progress downwardly within the dispenser housing in increments as the source roll is being depleted.

Further, each segregating device may be provided by a lever which is pivotally mounted intermediate its length so that the upper portion of the device on each side of the inner dispenser housing walls will be urged in a first direction by the weight of the reserve roll that is being retained thereon with the lever transmitting this weight force to press the lower portion of the lever forming the segregating device in a second direction which urges this lower portion against the guides and thus augments the spring biasing force already applied to the guides.

More specific features and structural components contributing to an improved construction for a wound roll dispenser may be found disclosed in my co-pending patent application Ser. No. 58,867 filed July 19, 1979. This earlier filed application is, in turn, a continuation of my patent application Ser. No. 897,431 filed Apr. 18, 1978 (now abandoned).

With the foregoing in mind, it is a principal object of the present invention to provide a flexible sheet material wound roll dispenser for handling a multiplicity of wound rolls with improved roll control for preventing overspinning or uncoiling of the source roll as may be promoted at the end of each dispensing cycle incident a user withdrawing the web from the source roll and out of the dispenser.

An important object of the invention is to provide a reserve roll segregating device which utilizes the weight of a reserve roll while it is retained in a reserve position to augment the braking action against overspinning or uncoiling of the spirally wound web from the source roll as is the tendency to occur at the end of each web dispensing cycle.

Another object of the invention is to provide a dispenser having opposite inwardly facing tracks to receive the spindles of rolls to be dispensed from the dispenser wherein a reserve roll segregating device is associated with each track to retain a roll in a reserve position and wherein the reserve roll is progressively lowered downwardly within the dispenser housing in increments as the source roll is depleted incident withdrawal of spirally wound web material from the source roll and out of the dispenser.

The above and other objects of the invention will become apparent upon consideration of the detailed description of a preferred embodiment of the invention given in connection with the following described drawings which form a part of this application.

DESCRIPTION OF A PREFERRED EMBODIMENT OF THE INVENTION

Figure 1:
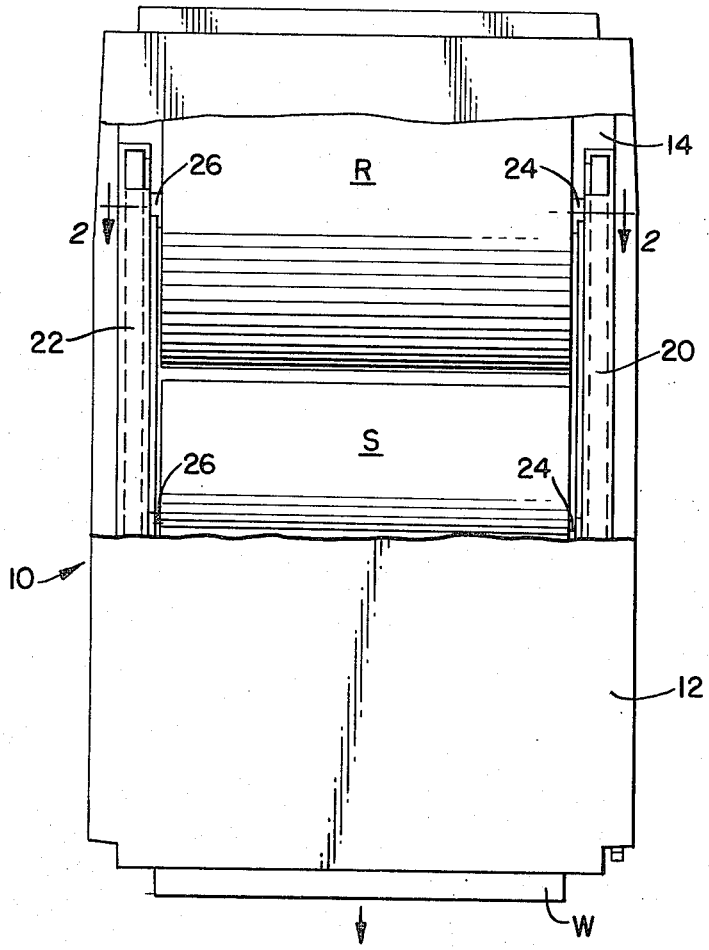
FIG. 1 is a front elevational view of the wound roll dispenser of this invention with a portion of the front cover broken away to expose components within the dispenser housing.

FIG. 1 provides a overall view of a complete dispenser to accommodate source and reserve rolls of flexible sheet material. This dispenser is provided with a housing 10 which may be appropriately comprised, as known in the art, of a cover 12 and chassis 14. The cover is appropriately supported on chassis 14 to readily enable its removal or opening so as to provide access to the attendant in servicing the components within the dispenser such as is necessary in replenishing the wound rolls of flexible sheet material.

It will of course by recognized that the rear wall of chassis 14, forming a part of housing 10, is appropriately constructed to accommodate its mounting on a wall surface at a location at which the dispenser is to be mounted for its intended dispensing use.

Figure 2:
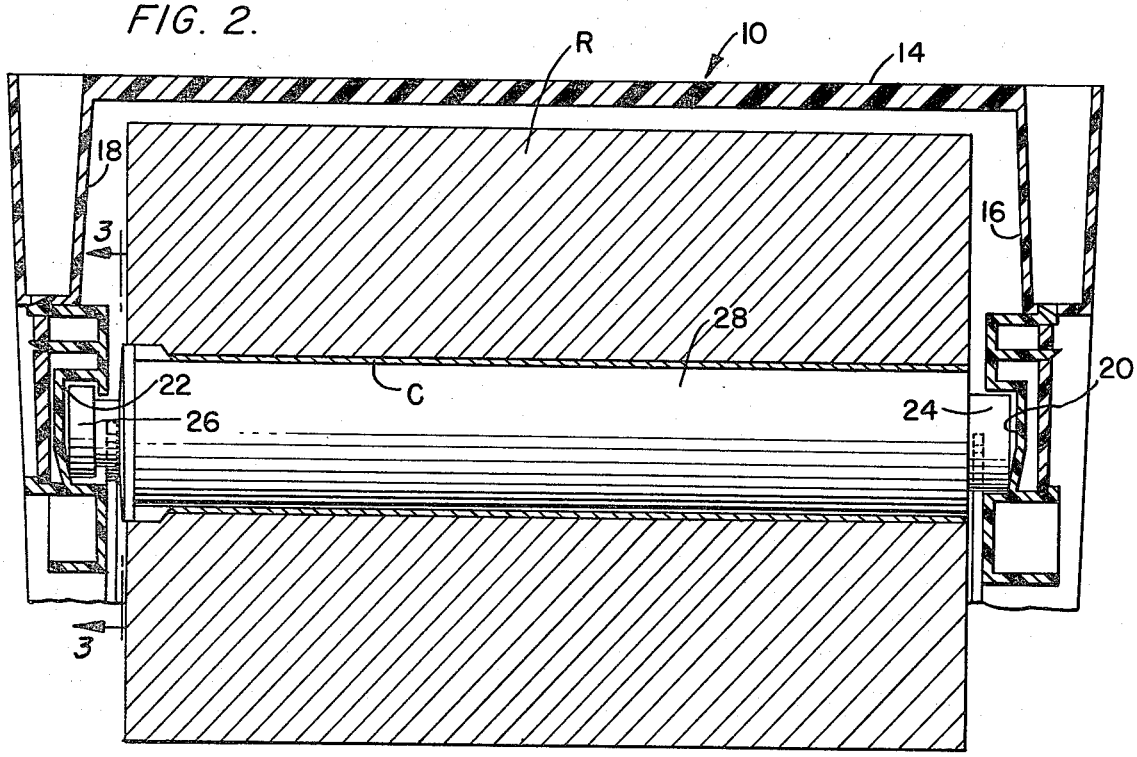
FIG. 2 is a sectional view taken on line 2—2 of FIG. 1.

The cover 12 is shown broken away on FIG. 1 to expose reserve roll R and source roll S as they would be mounted in operative positions interiorly of the dispenser housing 10. In the sectional view of FIG. 2 the cover is completely absent from chassis 14.

The chassis 14 of dispenser housing 10 provides side walls 16 and 18 which carry inwardly facing tracks 20 and 22, respectively. These side wall tracks 20 and 22 face inwardly to receive therein the spindles 24 and 26 projecting outwardly from the opposite ends of core C of the wound roll of flexible sheet material. As shown most clearly on FIG. 2, the spindles 24 and 26 are carried on the ends of a mandrel 28 which is frictionally held within the core C of the roll R. It will of course be understood that a similar mandrel 28 will be frictionally held within the core of the source roll S with the mandrel spindles 24 and 26 engaged within the inwardly facing 20 and 22, respectively. Thus, both the reserve roll R and source roll S will be supported on their respective spindles within the inwardly facing tracks in the positions as shown through the broken away portion of cover 12 on FIG. 1. Of course, instead of using a mandrel 28 to provide spindles 24 and 26 for each wound roll when it is supported within the dispenser, suitable end caps may be individually inserted at each end of the opposites ends of the core of each roll with each end cap providing one of the spindles 24 or 26.

Specific details relating to tracks 20 and 22, spindles 24 and 26, and other related features, as well as their function, need not be recited herein since they will be fully found to be set forth in the description and illustration provided in my prior patent application Ser. No. 58,867 filed July 19, 1979 which is now pending and which is a continuation of my earlier application Ser. No. 897,431 filed Apr. 18, 1978. Certainly reference may be made to the fuller disclosure contained in these earlier filed applications if needed with reference to and in the understanding of the invention of this application.

Further it will be understood from generally known features in the web dispensing art and also from the disclosures contained in my above-mentioned prior patent applications, that a web W (FIG. 1) will be withdrawn by the intending user out of an elongated slot (not shown) adjacent the lower end of the dispenser housing 10. This web will be drawn off of the wound roll S located in the dispensing or source position supported on tracks 20 and 22 within housing 10. A feed roller 30 (FIGS. 3 and 5) is appropriately rotatably mounted within housing 10 with the web W passing over feed roller 30 as it is withdrawn from source roll S on its path to leave the dispenser housing 10 through the opening adjacent the lower end of such housing.

As is conventional and in accordance with the disclosures of my above-mentioned prior applications, the source roll S rests on and is drivingly engaged with the periphery of feed roller 30. In the invention of this application, the driving interengagement between the feed roller 30 and the periphery of source roll S cooperates to control rotative movements of source roll S and in cooperation with the features hereinafter described reduces the possibility of overspinning or unspooling web material as it is unwound from the source roll S.

Before proceeding with a description specifically relating to the invention presented in this application, it may be well to note that each of FIGS. 3, 4, 5 and 6 is generally illustrative of only one side of the structure present on the opposite inner side walls 16 and 18 of chassis 14 forming a part of dispenser housing 10. It is to be understood that there are two inwardly facing tracks and that FIGS. 3–6 only show the construction of track 22 located on side wall 18 of the chassis 14. This structure is at the left side of the dispenser housing 10. The structure at the opposite or right side including track 20 and its associated parts will be identical, albeit, a mirror image of the left side illustrated in FIGS. 3–6.

Figure 3:
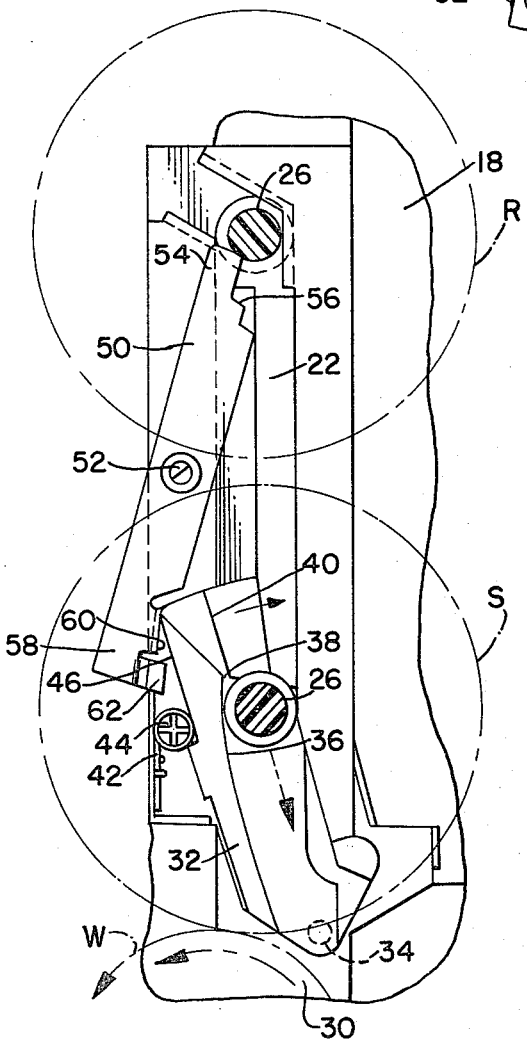
FIG. 3 is a fragmentary view, partly in section, taken on line 3—3 of FIG. 2.

FIG. 3 shows the left side inwardly facing track 22 that is carried on side wall 18 of the dispenser housing. A driving guide 32 is pivotally mounted at 34 to the lower end of track 22. In line with the comments hereinabove, a similar guide 32 is pivotally mounted at the lower end of track 20 on the right side or inner side wall 16 of dispenser housing 10. Guide 32 provides a friction surface 36 forming the lower wall of the slanting track section. The upper end of friction surface 36 on each guide 32 has a projection 38 with an inclined cam area 40 extending thereabove.

Each guide 32 is biased inwardly toward the center of the track with which it is associated. As shown on FIG. 3, track 22 has a spring 42 which is mounted on a suitable stationary stud 44. One end of spring 42 presses against a stationary part of the element providing track 22 while the other end of spring 42 presses against the outer wall of guide 32. Thus spring 42 biases guide 32 about its pivotal mounting 34 essentially in the manner and for the purpose described in my above referred to prior patent applications. Again, reference may be made to these earlier applications for a fuller explanation as to the interrelationship and functioning of the driving guides 32, springs 42 and their cooperation with spindles 24 and 26 extending outwardly from the ends of wound rolled material supported within the dispenser housing 10.

Figure 5:
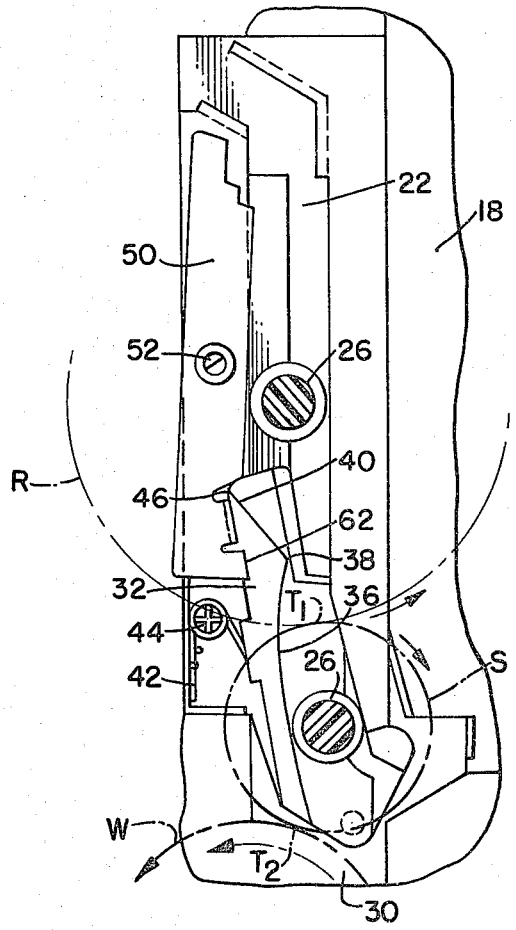
FIG. 5 is a view similar to FIG. 3 but showing the reserve roll segregating device fully released from its position of retaining the reserve roll.
Figure 6:
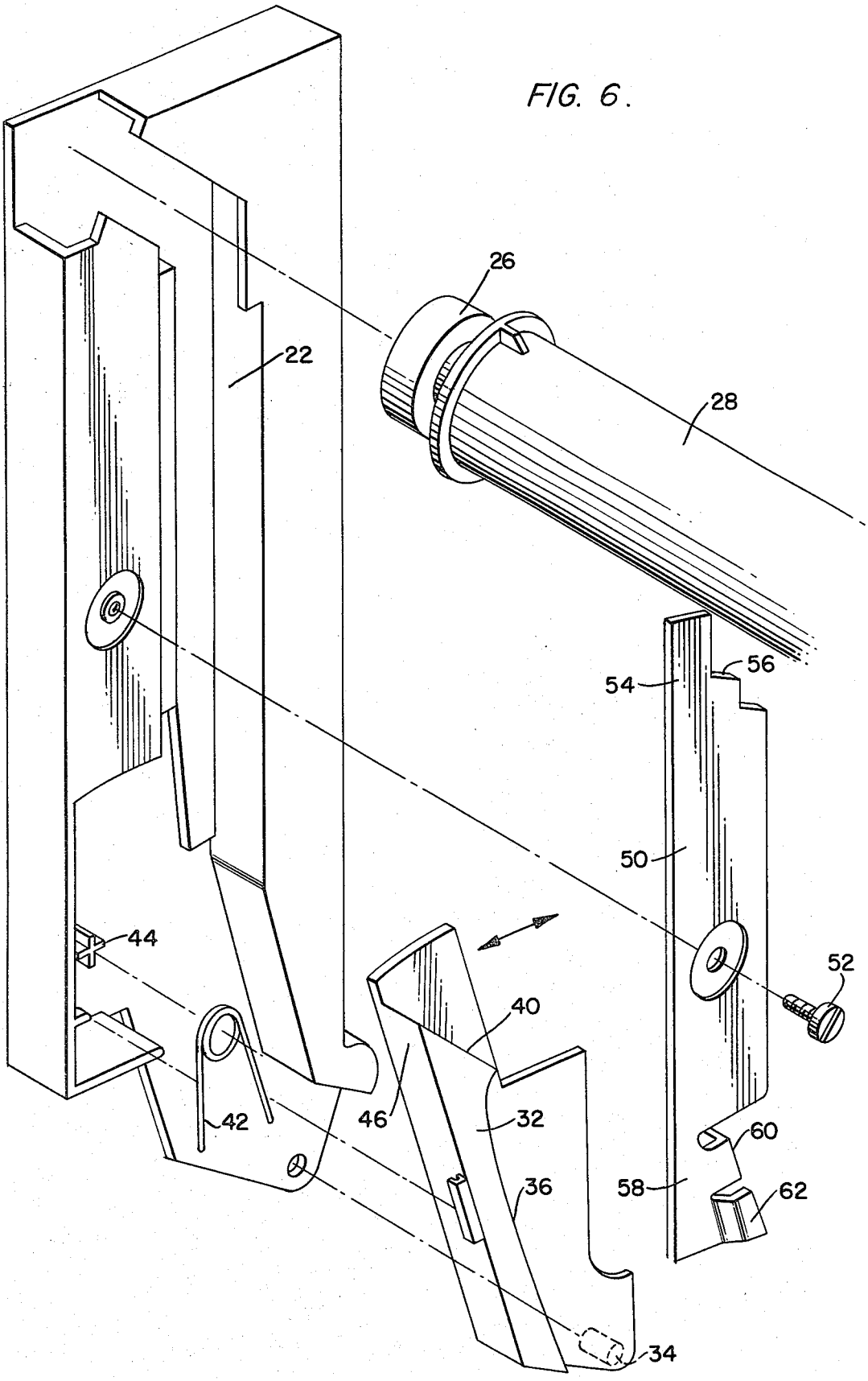
FIG. 6 is an exploded perspective view showing a roll mounting mandrel spindle relative to one of the inwardly facing dispenser housing tracks and related components associated with such track.

For a purpose that will become apparent, the driving guide 32 offers a pressure area 46 located in a position to the left of cam area 40 for the particular side wall construction shown on FIGS. 3, 5 and 6. It is against this pressure area 46 on driving guide 32 that the augmenting force derived from the reserve roll R retained adjacent the upper ends of tracks 20 and 22 is applied in the manner described hereinafter.

In addition to each of the pivotally mounted driving guides 32, one associated with each track 20 and 22, a reserve roll segregating device is provided by a lever 50. This lever is pivotally mounted intermediate its length by a screw 52 which may be conveniently threaded into the element providing track 22 on side wall 18 of the dispenser housing 10. Again it will be understood that a similar reserve roll segregating device in the form of a pivotally mounted lever 50 is mounted to be associated with track 20 on side wall 16 of the chassis 14 forming a part of dispenser housing 10.

Lever 50 has an upper portion 54 which is formed with a stepped configuration 56 that extends in a generally vertical direction or longitudinally of the lever 50. In the embodiment illustrated on FIGS. 3–6 the upper portion 54 of lever 50 is shown with two incremental steps defining the stepped configuration 56. It will of course be recognized that more or less steps may be provided to define the stepped configuration 56 depending upon the number of increments desired in the operation of progressively lowering a reserve roll R within the housing as the source roll S is depleted by withdrawal of web material therefrom.

In the relation of the parts as shown on FIG. 3, the upper portion 54 of lever 50 is in engagement with the spindle 26 extending axially from the core of reserve roll R with this spindle disposed within the track 22. In this condition the reserve roll R is retained adjacent the upper end of track 22. Of course the reserve roll segregating device formed by the lever 50 on the opposite inner side wall 16 of the dispenser housing 10 will likewise be engaging the reserve roll spindle 24 within the track 20 on the opposite inner sidewall of the dispenser housing so that by the combined action of the two segregating devices provided by levers 50 the reserve roll R is retained adjacent the upper ends of both tracks 20 and 22.

Each reserve roll segregating device provided by lever 50 has a lower portion 58 that is provided with an abutment 60. The abutment 60 is positioned so that it presses against the pressure area 46 on driving guide 32. The lower portion 58 on lever 50 may also have a tab 62 which, in operation of the mechanism, moves into overlapping relation with the side of guide 32 (FIG. 5) to effectively retain the lever 50 and guide 32 in properly aligned relation to each other.

From the above described structural features, the operational characteristics of the wound roll dispenser may be described and easily understood. FIG. 3 depicts the dispenser in its fully loaded condition with a full source roll S and a full reserve roll R. Each of the two rolls has spindles 24 and 26 extending axially outwardly from the ends of the roll core. In FIG. 3 the left end spindles 26 are shown for rolls R and S in the positions that they assume within track 22 when the dispenser is fully loaded.

First, considering loading the source roll S into its position, the spindles 24 and 26 of this roll are entered into the upper ends of tracks 20 and 22, respectively. The spindles move down within the tracks until the periphery of source roll S rests on the surface of feed roller 30 for the roll S to assume the position that it is shown as having in FIG. 3. At this point the spindle 26 will have pivot guide 32 about pivot 34 against the biasing force of spring 42 so that spindle 26 will have passed below projection 38 and friction surface 36 on guide 32 will then be pressed against the spindle by spring 42. The movement of guide 32 to this position will shift pressure area 46 while in engagement with abutment 60 on the lower portion 58 of lever 50 so that this lever, forming the reserve roll segregating device, will shift the upper portion 54 and stepped configuration 56 to be located relative to track 22 in the position shown on FIG. 3.

Then, the reserve roll R will have its spindles 24 and 26 introduced into the upper ends of tracks 20 and 22, respectively. With the upper portion 54 of levers 50 effectively blocking downward passage of the spindles 24 and 26 of roll R, this roll will be retained as the reserve roll adjacent the upper ends of the tracks 20 and 22. Thus the segregating devices provided by levers 50 hold reserve roll R up out of contact with the surface of the source roll S that is located in the dispensing position.

The web W is threaded from source roll S over feed roller 30 and through a web cutting or perforating mechanism, if such be provided in the dispenser, to pass out of the elongated opening at the bottom of dispenser housing 10, as shown in FIG. 1. Continued withdrawal of web W from roll S depletes the roll size. The friction surfaces 36 on dividing guides 32, while engaging the peripheries of the source roll spindles, promote source roll rotation during downward movement of roll S in the manner described and with the benefits described in my hereintofore mentioned prior applications.

Once the source roll S has been depleted such that the spindles 24 and 26 on such roll have allowed guides 32 under the urging the springs 42 to swing to the right as shown in FIG. 3, the levers 50 forming the reserve roll segregating devices will also pivot about there pivot screws 52 with abutment 60 of each lever pressing against the pressure area 46 of guides 32 to augment the biasing force applied to the guides by springs 42. In this connection, the weight of reserve roll R transmitted through its spindles 24 and 26 to the upper portions 54 of the levers 50 will urge the upper portions 54 in a first direction (to the left as shown in FIG. 3) with the weight of reserve roll transmitting a force through levers 50 to press the lower portions 58 and their abutments 60 in a second direction (to the right as shown in FIG. 3) and against the pressure areas 46 of guides 32.

Figure 4:
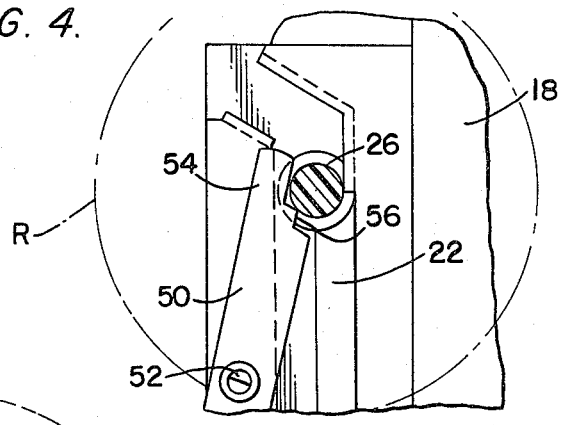
FIG. 4 is a view of part of the structure show in FIG. 3, but with the reserve roll segregating device shown in an intermediate position relative to a reserve roll spindle.

At a point before full depletion of source roll S, the levers 50 will have moved sufficiently such that the stepped configuration 56 will assume the position as shown in FIG. 4 whereat the spindles 24 and 26 of reserve R will progress downwardly along stepped configuration 56 to a position such as shown for spindle 26 of roll R on FIG. 4. Thus, the reserve R progresses downwardly in increments as the source roll S is depleted.

After the reserve roll R has been lowered progressively in increments along the stepped configuration 56 on upper portion 54 of levers 50, the levers 50 will eventually move to the position as shown in FIG. 5 where the source roll S has become nearly depleted. With the levers 50 moved out of the way as shown in FIG. 5, the reserve roll R and its spindles 24 and 26 will progress downwardly until the external surface of reserve roll R is resting on the surface of source roll S as shown in FIG. 5. At this point, the levers 50 are free to move without any force being transmitted from abutment 60 to pressure area 46 on guide 32. Accordingly, the reserve roll spindles may move downwardly with the guides 32 acting solely under the actuating bias of springs 42. This will provide the action normally provided by driving guides 32 absent the reserve roll segregating device of levers 50.

A generalized discussion concerning the dispensing of web materials such as paper towels may be helpful in understanding the objectives and benefits achieved by the invention. First, the source roll S is in pressure contact with feed roller 30 and it is necessary to control the moment of inertia of these rotating and related components. This must be done to prevent the source roll S from excessively uncoiling its spirally wound web W at the end of each dispensing cycle. When the rotation of feed roller 30 is stopped, the rotation of source roll S must also be stopped. Where the arresting force is applied near the axis of the source roll S, as is achieved by the pivotally mounted guides 32, a greater arresting force is needed to maintain a "tight wrap" on the source roll S. When the source roll is a full roll of maximum size it has the greatest moment of inertia due to its greater mass. Similarly, when the source roll is reduced in size as the web of material is depleted therefrom, its moment of inertia diminishes proportionately.

Realistically, the force required to control a full source roll S by reliance on the biasing force of springs 42 acting against guides 32 would be too great. It would be far to great when the source roll is reduced in size for the web W then to be comfortably withdrawn from the dispenser. Therefore, in a dispenser where a reserve roll R is used, a roll segregating brake loading device is employed. This device, provided by levers 50, transmits a force vector equal to the weight of the reserve roll R through the contacting points of the roll spindles with the upper portions 54 of the levers 50. This force, added to the force of springs 42, is sufficient to prevent appreciable overspin of the source roll S at the end of each feeding cycle of web W.

When the source roll S is substantially depleted, the guides 32 will pivot at 34 to thereupon allow the levers 50 to move a distance sufficient to clear the tracks 20 and 22, and permit the reserve roll R to drop onto the source roll S. At this stage, the source roll S has been decreased in size so that the surfaces of the spindles 24 and 26 are contacting points on the surfaces 36 of guides 32 that are located closer to pivots 34, thus applying a force greater than the starting force generated solely by springs 42. This, coupled with the location of the roll surface contact tangent point T1 between source roll S and reserve roll R, and the tangent point T2 between source S and feed roller 40, eliminates the need for additional braking force supplied through the reserve roll segregating device of levers 50. The increasing extent of the peripheral wrap of web W rearwardly (FIG. 5) from T1 to T2 essentially eliminates any "looping" or, in any event, a small loop that may be formed will be pulled out at the start of each feeding cycle.

The foregoing sets forth a detailed description of a dispenser for multiple rolls of wound flexible sheet material. It is to be recognized that various modifications of the dispenser of this invention may occur to those skilled in the art. Therefore, the scope of the invention is to be limited solely the scope of the appended claims.

I claim:

1. A dispenser for wound rolls of flexible sheet material that have supporting spindles projecting outwardly from the roll core ends comprising:

a dispenser housing to receive the rolls to be dispensed having inwardly facing tracks on the opposite inner sidewalls of said housing for the rolls to move downwardly within said housing along said tracks;

movably mounted roll driving guide means positioned adjacent the lower end of each said track, each said guide means providing a friction surface to engage the periphery of a source roll spindle within the track and promote source roll rotation during said downward movement of the roll;

means biasing each said guide means toward the center of the track with which it is associated;

a movably mounted reserve roll segregating device associated with each track having an upper portion to engage a reserve roll spindle within the track to retain the reserve roll adjacent the upper ends of said tracks, said device having a lower portion pressing against said guide means to augment said biasing means in urging said friction surface against the periphery of the source roll spindle within the track; and a feed roller rotatably mounted within said housing adjacent the lower ends of said tracks to drivingly engage with the periphery of the source roll.

2. A dispenser as recited in claim 1 wherein said guide means is pivotally mounted relative to each said track, and each said segregating device includes a pivotally supported lever.

3. A dispenser as recited in either of claims 1 or 2 wherein said upper portion of each said segregating device has a stepped configuration in a generally vertical direction to permit the reserve roll to progress downwardly within said housing in increments as the source roll is depleted.

4. A dispenser as recited in claim 3 wherein each of said tracks has the lower end section slanting away from the longitudinal axis of the main length of the track.

5. A dispenser as recited in either of claims 1 or 2 wherein said lower portion of each said segregating device pressingly engages against the upper end of said guide means with the guide means being pivotally mounted adjacent its lower end.

6. A dispenser as recited in claim 5 wherein said segregating device is pivotally mounted intermediate its length with said upper portion being urged in a first direction by the weight of a reserve roll retained thereon so as to press said lower portion of said segregating device in a second direction against said guide means.

* * * * *